United States Patent [19]

Malzahn

[11] Patent Number: 4,945,999

[45] Date of Patent: Aug. 7, 1990

[54] DIRECTIONAL ROD PUSHER

[75] Inventor: G. Edwin Malzahn, Perry, Okla.

[73] Assignee: The Charles Machine Works, Inc., Perry, Okla.

[21] Appl. No.: 333,678

[22] Filed: Apr. 6, 1989

[51] Int. Cl.[5] ..... E21B 4/06; E21B 7/06; E21B 7/26; E21B 44/00

[52] U.S. Cl. ..... 175/19; 175/61

[58] Field of Search ..... 175/19, 61, 62; 173/35; 74/99 R

[56] References Cited

U.S. PATENT DOCUMENTS

| | | | |
|---|---|---|---|
| 4,271,711 | 6/1981 | Vavra | 74/99 R X |
| 4,304,142 | 12/1981 | Blomstrom | 74/99 R X |
| 4,834,193 | 5/1989 | Leitko, Jr. et al. | 175/19 |

*Primary Examiner*—William P. Neuder

*Attorney, Agent, or Firm*—Banner, Birch, McKie & Beckett

[57] ABSTRACT

The present invention comprises a rod pusher device which moves a drill string having a directional boring bit at its leading end. The invention includes a conversion device, such as a RIGID link, mounted between a fixed point on the hydraulic thrust cylinder or frame assembly and the moveable drill string to automatically and simultaneously convert the axial movement of the thrust cylinder and drill string into a combined axial and rotational movement of the drill string. The link is removable so that the push rod operator can readily select between axial movement of the drill string or combined axial and rotational movement, and thereby control the path of the borehole.

17 Claims, 4 Drawing Sheets

DIRECTIONAL ROD PUSHER

BACKGROUND OF THE INVENTION

This invention relates to drilling an underground borehole for installing underground utility lines without excavating a trench. More particularly, the invention relates to a directional rod pusher for moving a string of push rods through the earth to form the borehole. Specifically, the invention relates to an improved directional rod pusher wherein rotational movement of the push rod may be automatically and simultaneously effected upon axial movement of the push rod.

The benefits of trenchless digging for installing underground utility lines are well-known, as disclosed, for example, in U.S. Pat. Nos. 4,306,626 and 4,694,913. A number of different types of devices are available for the purpose of installing underground utility services without cutting an open trench. These include percussion boring tools, rotary boring tools, push rod boring systems, and earth augers. The present invention relates to a push rod boring system. Each of these different types of underground boring devices has a specific purpose and specific operating characteristics. Their use depends on the type of soil in which the borehole will be formed, the length and diameter of the borehole, conditions at the job site, and a number of other factors.

In a typical percussion boring tool, an internal striker or hammer is reciprocated against an anvil or tip to propel the tool through the soil. These tools pierce and compact compressible soils as they form the borehole. A typical percussion boring tool is shown, for example, in U.S. Pat. Nos. 4,621,698, and 4,632,191.

Rotary boring tools use a rotatable "mole" or boring bit to drill through the earth. The mole may be rotated by a downhole motor adjacent the mole or by a surface based drive system. U.S. Pat. Nos. 3,529,682 and 3,589,454 disclose a rotary mole in combination with a complex mole tracking system.

Earth augers are large, powerful screw-type drills for digging horizontal boreholes. These devices are used primarily for digging large diameter boreholes or digging in difficult soil conditions.

A rod pusher is a relatively simple, compact device for sequentially thrusting an increasing string of "push rods" through the ground from a small subsurface starting pit. Such a device can easily be set up and made operational within an hour or two, including excavation of the starting pit. Usually the push rod uses a drill bit having a cutting tip fixed to its leading end. Successive lengths of push rod are pieced together to form a drill string, which forms the borehole. A push rod boring system is disclosed, for example, in U.S. Pat. Nos. 4,306,626 and 4,694,913.

In recent years, new techniques have been developed to allow tracking the progress (i.e., location and depth) of the various types of underground boring devices. Also, there have been various means developed to correct the path of the borehole as the tool progresses, if it begins to deviate from the desired path because of changing soil conditions, rocks, or other obstructions.

In particular, McDonald, U.S. Pat. No. 4,694,913, discloses a rod pusher device having directional control. The directional control is achieved by using a drill bit having an angled or beveled face. As the drill string is pushed through the soil without rotation, the resultant soil forces on the drill bit act at an angle to the centerline of the borehole and string of rods. The perpendicular component of this resultant force tends to cause the head to deviate from its course along a curved path as the string of rods continues to be advanced axially as long as the beveled face of the drill is first maintained in this same orientation, the path of the drill string will follow a continuous curve. An essentially straight borehole can be formed by rotating the beveled drill bit as it is advanced through the soil. When a steering correction is desired, the rotation is stopped with the drill bit oriented to cause deviation of the drill bit back to the desired path. Electronic tracking means known in the art are used to determine the need for path corrections and to indicate the drill bit orientation and thus the orientation of the beveled face.

In order to achieve the rotational motion necessary for directional control of a rod pusher device, McDonald uses a broadly disclosed motor and control assembly which provides either axial movement to the drill string or combined axial and rotational movement. This device requires, however, a complex and expensive control mechanism.

Duke, U.S. Pat. No. 4,306,626 discloses a basic rod pusher device without direction control. It is a very economical directional boring system. This rod pusher device incrementally advances push rods into a bore by gripping the rod with a jaw mechanism that is thrust forward by a hydraulic cylinder. At the end of each cylinder stroke, the jaws are released from the rod and the cylinder is retracted for the next pushing increment. Additional rods are added to the back end of the drill string as needed.

A device such as disclosed in Duke may be made steerable by using a beveled face drill bit attached to the leading end of the string of push rods. However, the simple and economical Duke rod pusher does not have any means for imparting rotary motion to the drill bit. Thus, when a directional boring head is used with this rod pusher, the string of rods must be rotated manually by the crew through use of a pipe wrench or by pushing on the jaw handle. This is a tedious and tiring operation.

The present invention is a simple yet effective means to provide directional control and steering capabilities for rod pusher devices. The invention automatically and simultaneously causes rotational movement of the drill string upon axial movement of the drill string. The invention is used in the context of a simple rod pusher which only has drive means for imparting axial movement to a drill string and does not have any motors or other power sources for causing rotational movement to a drill string.

SUMMARY OF THE INVENTION

In its preferred form, the present invention is used in conjunction with a rod pusher device such as disclosed in Duke, U.S. Pat. No. 4,306,626, in which a coupling or gripping assembly couples a hydraulic thrust cylinder to a drill string so that the drill string is moved axially by the thrust cylinder. It will be readily apparent, however, that the invention is not limited to the specific structure of the preferred embodiment.

The present invention comprises a rod pusher device which moves a drill string having a directional boring bit at its leading end. The invention includes a conversion device, such as a rigid link, mounted between a fixed point, such as on the hydraulic thrust cylinder or frame assembly, and a moveable point, such as on the moveable coupling assembly, to automatically and simultaneously convert the axial movement of the thrust cylinder and drill string into a combined axial and rotational movement of the drill string. The link is removable so that the push rod operator can readily select between axial movement of the drill string or combined axial and rotational movement, and thereby control the path of the borehole.

The present invention provides a passive, self-generated means of rotating the coupling assembly as the rod pusher hydraulic cylinder advances the coupling assembly and thus the string of push rods gripped by the coupling assembly. The grip of the coupling assembly onto the rod must by design be sufficient to overcome soil resistance against the drill string as it forms the borehole. This grip is also sufficient to transmit a rotational force to the drill string.

DETAILED DESCRIPTION

Figure 1:
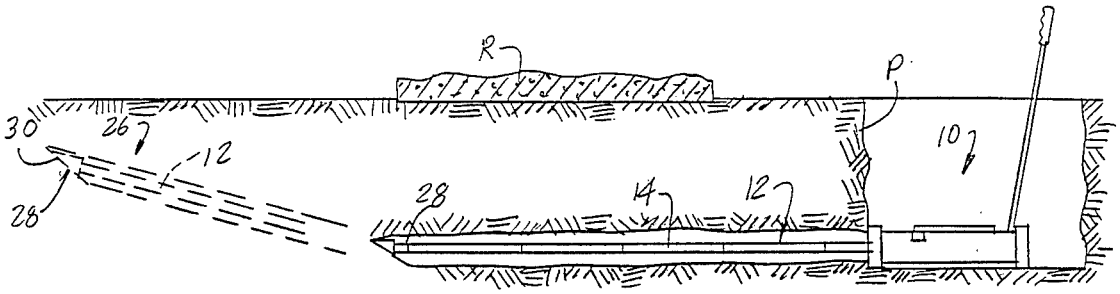
FIG. 1 is a schematic drawing, partially in section, of a push rod boring system according to the present invention.
Figure 2:
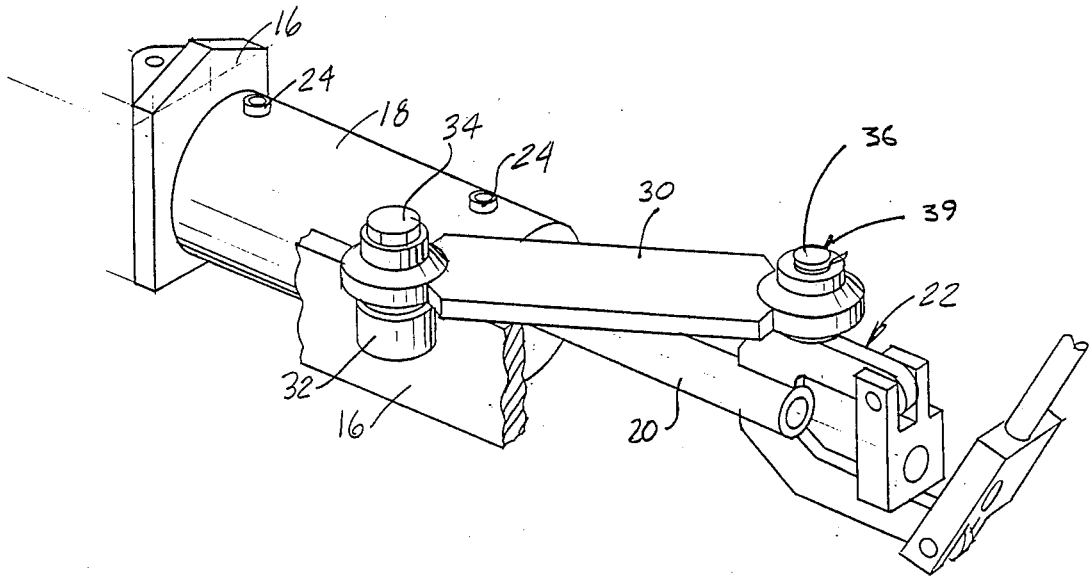
FIG. 2 is a perspective view of a thrust cylinder and coupling assembly according to a preferred form of the invention.
Figure 3:
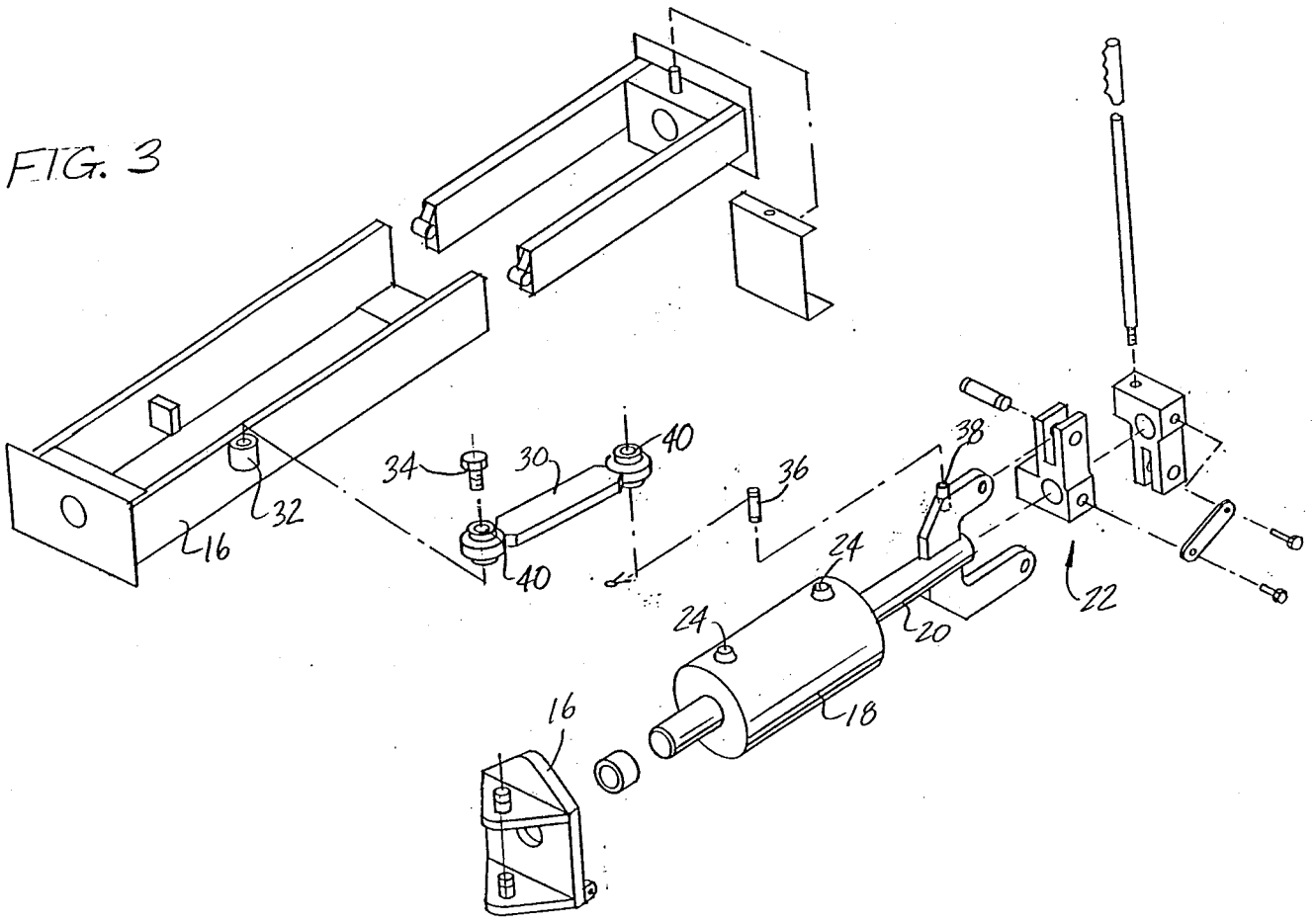
FIG. 3 is an exploded perspective view of a push rod assembly according to a preferred form of the present invention.

A push rod boring system 10 is shown generally in FIG. 1. Boring system 10 is shown positioned in a launching pit P. However, boring system 10 may also be positioned directly on the surface and enter the earth at an angle to the surface. Boring system 10 may be directed to a target pit or may be directed towards a surface target.

Boring system 10 is positioned to dig a borehole under a surface obstacle, such as a roadway R, by pushing a drill string 12 through the earth. Drill string 12 is made up of a plurality of push rods 14, which are connected together to make a borehole of the desired length. Push rods 14 are typically solid steel rods which have threaded connections on each end which permit them to be connected to each other to form a drill string. The threaded connections are also used to attach a boring bit to the leading end of the drill string for rotation therewith. Preferably, a special tapered thread profile, similar to an oil field (API) thread, is used for improved joint strength and to speed making-up or breaking-out joints. The rods can be coupled or uncoupled in only three and one-half turns, about half that needed for straight threads.

After the borehole is dug, the drill string is retracted from the borehole. To facilitate installation of a utility service in the borehole, the utility lines to be installed may be connected to the drill string at its target end and pulled through the borehole as the drill string is retracted.

The general structure and operation of the preferred form of boring system 10 is fully described in U.S. Pat. No. 4,306,626. Boring system 10 includes a fixed frame assembly 16 which is positioned in launching pit P. A fluid cylinder 18 capable of exerting axial thrust in both a forward and reverse direction is fixed within frame assembly 16. The thrust cylinder is of double rod-end design. Therefore, its force capability pulling on the string of rods is the same as when pushing. In the preferred form of the invention, a hollow cylinder rod 20 is connected at one end to axially moveable piston head of fluid thrust cylinder 18. Cylinder rod 20 is coaxially mounted around push rods 14. This allows thrust to be transmitted concentric with the push rods. The other end of cylinder rod 20 includes a reversible coupling assembly 22 for releasably coupling solid steel push rods 14 to the axially moveable cylinder rod 20.

Boring system 10 includes appropriate fluid lines 24 for supplying fluid to thrust cylinder 18 to move the axially moveable piston head of the thrust cylinder, and thus the cylinder rod 20, in either a forward or reverse direction, as desired.

The leading end 26 of drill string 12 includes a directional boring bit 28. Boring bit 28 may include an electronic transmitter or similar device for tracking its position and orientation. A surface receiver detects the signal of the transmitter and allows the operator to determine the position, depth and orientation of the boring bit. Boring bit 28 has a beveled face 30. When drill string 12 and boring bit 28 are simultaneously moved axially and rotated, boring bit 28 will drill in a substantially straight path. When drill string 12 and boring bit 28 are not rotated but moved axially, boring bit 28 will drill in a curved path.

Fluid thrust cylinder 18 is capable only of exerting an axial force on drill string 12 through cylinder rod 20 and coupling assembly 22 as its piston head moves axially back and forth. There are no means for supplying a rotative force necessary to provide directional control of the drill string.

In order to impart rotary motion to cylinder rod 20 and coupling assembly 22, and thereby to drill string 12, a rigid link 30 is attached between the linearly movable drill string and a fixed anchor point. Preferably, the moveable end of the link is fixed to the linearly moveable coupling assembly 22. The fixed end of the link is preferably connected to the stationary frame 16 of the rod pusher 10. As fluid cylinder 18 is stroked forward to advance the drill string 12, link 30 forces cylinder rod 20 and coupling assembly 22 to rotate clockwise as viewed looking down the borehole. The direction of rotation is chosen to be the same as that used to join together the threadably connected push rods 14 in order to preserve the integrity of the string.

In the preferred form of the invention, a bracket 32 is fixed to frame assembly 16 as the anchor point. A bolt 34 extends through a bushing assembly 40 in one end of link 30 to connect the fixed end of link 30 to the anchor point of bracket 32. The moveable end of link 30 is fixed to coupling assembly 22 by a pin 36 which extends through a similar bushing assembly 40. Pin 36 is threadable installed in a top surface of coupling assembly 22. A clip 39 serves to retain link 30 on pin 36.

Figure 4:
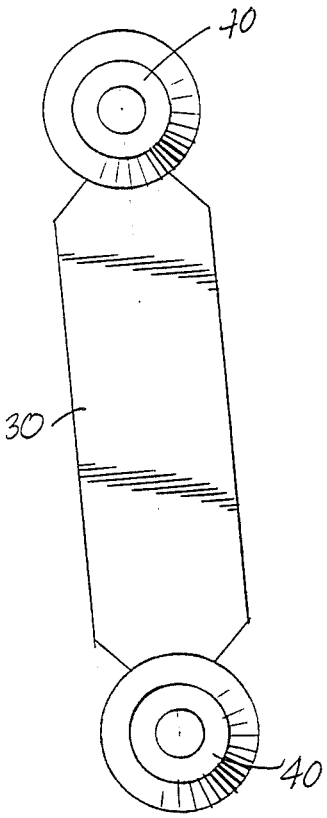
FIG. 4 is a top plan view of a conversion link according to a preferred form of the present invention.
Figure 5:
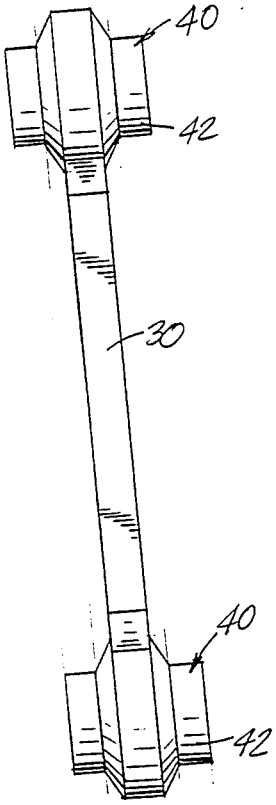
FIG. 5 is a side plan view of the conversion link shown in FIG. 4.

As shown in FIGS. 4 and 5, link 30 includes a ball joint-type bushing assembly 40 at each of its ends. These bushing assemblies include a center bush 42 which is free to rotate about its central axis.

Figure 6:
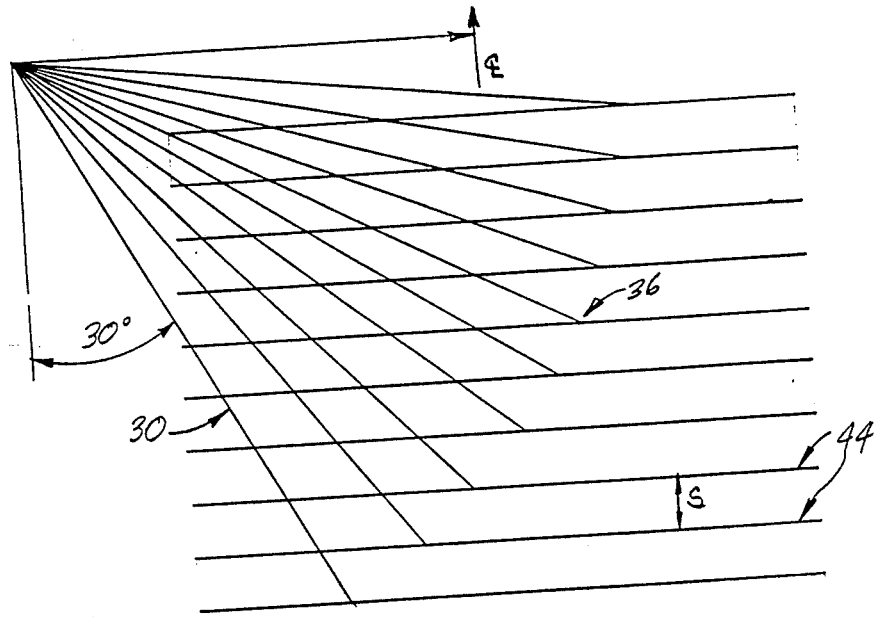
FIG. 6 is a top view of a geometric representation of the path of travel of the conversion link of the present invention when the conversion link is fixed in place.
Figure 7:
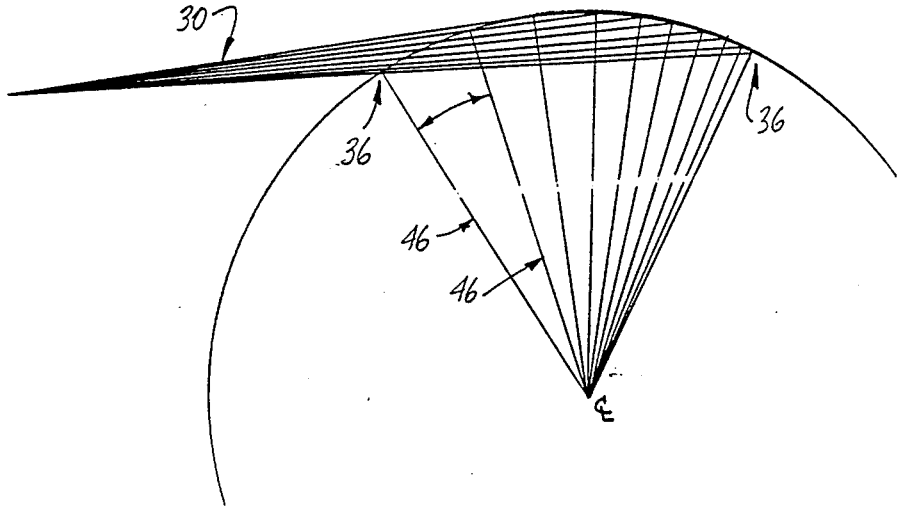
FIG. 7 is a front view of a geometric representation of the path of travel of the conversion link shown in FIG. 6.

The rotary motion effected per inch of cylinder travel is depicted in FIGS. 6 and 7. In the preferred form of the invention, approximately 60 degrees of rotation occurs with every complete stroke of thrust cylinder 18.

As shown in FIGS. 6 and 7 there is a greater degree of rotation in the begining of each cylinder stroke than at the end of the stroke. Thus, a higher rate of rotation per unit distance bored is possible by short cycling the cylinder.

In FIGS. 6 and 7 fixed bracket 32, link 30, and pin 36 are shown schematically. Arrow B corresponds to the direction of the forward travel of drill string 12. As shown in FIGS. 6 and 7, at the starting point of each forward cycle of fluid thrust cylinder 18, the moveable end of link 30 is off-center from the axial centerline of the borehole. Preferably, the starting point is as far counterclockwise as possible and the ending point is as far clockwise as possible. This allows the maximum amount of rotation per cycle without interfering with the structure of the rod pusher. Thus, in a preferred form of the invention, the path of pin 36 during each forward cycle is preferably from a position of −30° to +30° from the centerline of the borehole, as shown in FIG. 7.

The spaces between each horizontal line 44 in FIG. 6 corresponds to approximately one inch of forward travel of drill string 12, using a preferred stroke of 9 inches. The spaces between each radial line 46 in FIG. 7 also corresponds to approximately one inch of forward travel. The change in angular position of pin 36 is clearly greater during the beginning of each cycle than at the end of the cycle. By way of example, if link 30 is approximately 12 inches long, and if each forward cycle stroke of thrust cylinder 18 is approximately 9 inches, and if bracket 32 is approximately 5 inches from the axial centerline of the borehole, then the change in angle with respect to the axial centerline of pin 26 will be approximately 15° during the first inch of axial movement, but only approximately 2° during the last inch of axial travel.

Once cylinder 18 has been fully stroked forward, the operator reverses its control valve to retract cylinder rod 20 for another pushing increment. The rod pusher cylinder is preferably cycles back and forth by a control valve in the hydraulic circuit. An electric solenoid valve is preferred over a manual control valve on longer bores for improved productivity.

Coupling assembly 22 is released from drill string 12 during the reverse movement of the cylinder rod 20 so that the string remains stationary in the borehole. During this reverse portion of the cycle, link 30 causes cylinder rod 20 and coupling assembly 22 to rotate counterclockwise back to their original starting position. This cycle is repeated as long as a straight bore is desired.

When steering corrections are necessary, the boring bit 28 is rotated so that beveled face 30 is in the proper orientation. This may be done by "short cycling" the stroke, if necessary, to cause faster rotation of the drill bit and drill string. Link 30 is then removed from coupling assembly 22 by removing clip 39. Link 30 may be stowed along the frame assembly. The operator then continues to advance the string of rods without rotation until another steering correction is desired.

Although a preferred embodiment of the invention has been shown and described, the invention is not intended to be limited thereto. Various modifications will be readily apparent to those of ordinary skill in this technology, and the invention is to be limited only by the following claims.

I claim:

1. In a device for forming a borehole through the earth having a directional boring head mounted on one end of a push rod and axially moveable thrust for exerting an axial force on the push rod to thereby move the push rod through the earth, the improvement comprising:

conversion means mounted between said thrust means and said push rod for directly transforming the axial movement of the thrust means into combined axial and rotational movement of the push rod.

2. The device recited in claim 1 wherein said thrust means comprising a coupling assembly for coupling said thrust means and said push rod so that said coupling assembly and said push rod are axially movable in tandem in response to axial movement of said thrust means, and wherein said conversion means comprises a link connecting said coupling assembly to said thrust means.

3. The device recited in claim 2 wherein said thrust means comprises a fixed frame assembly and wherein one end of said link is attached to said fixed frame assembly and the other end of said link is fixed to said coupling assembly and moves axially therewith.

4. The device recited in claim 3 wherein said link comprises bushing means for mounting said link to said fixed frame and said coupling assembly.

5. The device recited in claim 4 wherein said bushing means comprises a ball joint.

6. The device recited in claim 3 wherein said thrust means operates cyclically and wherein the end of said link fixed to said coupling assembly begins each cycle positioned on one side of the axial certerline of the borehole and completes each cycle positioned on the other side of the axial certerline of the borehole.

7. The device recited in claim 2 wherein said link is removably connected so that when said link is connected axial movement of said thrust means causes both axial and rotational movement of said push rod, and when said link is unconnected axial movement of said thrust means causes only axial movement of said push rod.

8. The device as recited in claim 2 wherein said thrust means operates cyclically in a forward direction towards the directional boring head and in a reverse direction away from the directional boring head and wherein axial movement in the forward direction causes rotational movement of said coupling assembly in one rotational direction and axial movement in the reverse direction causes rotational movement of said coupling assembly in a rotational direction opposite from said one rotational direction.

9. The device as recited in claim 1 wherein said thrust means operates cyclically and each cycle of said thrust means causes a partial rotation of said push rod.

10. The device as recited in claim 9 wherein said conversion means causes a non-uniform rotation of said push rod during each cycle.

11. The device recited in claim 7 wherein the amount of rotation of said push rod during the first half of each cycle is greater than the amount of rotation during the second half of each cycle.

12. A directional rod pusher for forming a borehole through the earth in which a directionally controllable push rod is moved through the earth by a fluid thrust cylinder mounted in a fixed frame assembly and in which a coupling assembly is moved axially by an axially movable member of the fluid thrust cylinder and wherein the coupling assembly couples the axially moveable member of the fluid thrust cylinder to the push rod, the improvement comprising:

conversion means connected between the frame and the coupling assembly for selectively converting axial movement of the axially movable member of the fluid thrust cylinder into combined axial and rotational movement of said coupling assembly and said push rod.

13. The directional rod pusher recited in claim 12 wherein siad conversion means comprises a selectively removable rigid link fixed at one end thereof to the frame assembly and fixed at the other end thereof to the coupling assembly, so that when said link is fixed in position axial movement of the axially movable member of the fluid thrust cylinder causes combined axial and rotational movement of said coupling assembly and said push rod, and when said link is not fixed in position axial movement of the axially movably member causes only axial movement of said coupling assembly and said push rod.

14. The directional rod pusher recited in claim 13 wherein said fluid thrust cylinder operates cyclically and wherein said link when fixed in position is placed so that the rotation of said coupling assembly and said push rod during each cycle of said fluid thrust cylinder is non-uniform.

15. A directional rod pusher for forming a borehole through the earth in which a directionally controllable push rod is moved through the earth by axial force means for applying an axial force to the push rod, the improvement comprising:

passive rotation means for automatically and simultaneously causing rotational movement of said push rod upon axial movement of said push rod.

16. The directional rod pusher as recited in claim 15 wherein said passive rotation means is selectively engageable between an engaged configuration in which said passive rotation means causes said rotational movement of said push rod upon axial movement of said push rod to thereby direct said push rod on a substantially straight path, and a non-engaged position in which said push rod moves axially without rotation to thereby direct said push rod in a substantially curved path.

17. The directional rod pusher as recited in claim 16 in which said axial force means operates cyclically and wherein the amount of said rotational movement of said push rod during each cycle of said axial force means is non-uniform.

* * * * *

UNITED STATES PATENT AND TRADEMARK OFFICE

CERTIFICATE OF CORRECTION

PATENT NO. : 4,945,999

DATED : August 7, 1990

INVENTOR(S) : G. Edwin Malzahn

It is certified that error appears in the above-identified patent and that said Letters Patent is hereby corrected as shown below:

ON TITLE PAGE: under References Cited, please add the following
U.S. Patents:

| | | |
|---|---|---|
| 3,529,682 | 9/1970 | Coyne et al. |
| 3,589,454 | 6/1971 | Coyne |
| 4,306,626 | 12/1981 | Duke et al. |
| 4,694,913 | 9/1987 | McDonald et al. |
| 4,621,698 | 11/1986 | Pittard et al |
| 4,632,191 | 12/1986 | McDonald et al. |

Column 5, line 16, insert --CL-- after "centerline"; and

Column 5, line 26, insert --S-- after "spaces".

Figure 6, lable arrow as "B" in place of the designation shown.

Signed and Sealed this

Tenth Day of March, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,945,999

DATED : August 7, 1990

INVENTOR(S) : G. Edwin Malzahn

It is certified that error appears in the above-identified patent and that said Letters Patent is hereby corrected as shown below:

Column 6, line 7, insert --means-- after "thrust".

Signed and Sealed this

Twenty-seventh Day of October, 1992

*Attest:*

DOUGLAS B. COMER

*Attesting Officer*

*Acting Commissioner of Patents and Trademarks*